United States Patent [19]

Bonnefoi et al.

[11] Patent Number: 4,722,177

[45] Date of Patent: Feb. 2, 1988

[54] ROBOT FOR LOADING AND UNLOADING REELS OF METAL WIRES FOR A WIRE STRANDING MACHINE FOR MANUFACTURING CABLES

[75] Inventors: Serge Bonnefoi, Bethune; Roger Lemaire, Lievin; Serge Roye, Annoeullin, all of France

[73] Assignees: Fils et Cables D'Acier De Lens (FICAL), Loisons Sous Lens; Serame, Avelin, both of France

[21] Appl. No.: 916,736

[22] Filed: Oct. 8, 1986

[30] Foreign Application Priority Data

Oct. 8, 1985 [FR] France ..... 8514878

[51] Int. Cl.[4] ..... D07B 7/02; D07B 3/04; D01H 9/00

[52] U.S. Cl. ..... 57/266; 57/58.34; 57/268; 57/314; 242/25 R; 242/35.5 A

[58] Field of Search ..... 57/266-268, 57/270, 314, 58.3-58.38; 242/25 R, 25 A, 18 R, 35.5 A

[56] References Cited

U.S. PATENT DOCUMENTS

| | | | |
|---|---|---|---|
| 3,429,115 | 2/1969 | Purdy et al. | 57/266 |
| 3,468,115 | 9/1969 | Goodfellow et al. | 57/58.34 X |
| 3,563,020 | 2/1971 | Harris et al. | 57/58.34 X |
| 4,558,563 | 12/1985 | Witherden | 57/266 |
| 4,628,676 | 12/1986 | Lepach et al. | 57/266 |

FOREIGN PATENT DOCUMENTS

| | | |
|---|---|---|
| 964298 | 5/1957 | Fed. Rep. of Germany . |
| 966164 | 7/1957 | Fed. Rep. of Germany . |
| 1929024 | 12/1970 | Fed. Rep. of Germany . |
| 2508948 | 1/1983 | France . |

*Primary Examiner*—John Petrakes

*Attorney, Agent, or Firm*—Wenderoth, Lind & Ponack

[57] ABSTRACT

A robot for loading and unloading reels (40, 70) of metal wires on a tubular stranding machine (1) for manufacturing cables from wires unwound from the reels which includes a mechanical unit (3, 4) having a motorized device (3) provided with tongs (14) for seizing the reels. The motorized device 3 is capable of moving from one end of the stranding machine (1) to the other under the action of driving means (11) so as to extract therefrom empty reels (70) and replace them with full reels (40) previously prepared and stored in supply passageways each corresponding to a wire diameter. A microcomputer system is provided for the automatic control of operations carried out by the mechanical unit (3, 4). This robot considerably improves the productivity of the stranding machine and diminishes the risks of accidents for the operator supervising the latter.

15 Claims, 10 Drawing Figures

ROBOT FOR LOADING AND UNLOADING REELS OF METAL WIRES FOR A WIRE STRANDING MACHINE FOR MANUFACTURING CABLES

BACKGROUND OF THE INVENTION

1. Field of the Invention

The present invention relates to a robot for loading and unloading reels of metal wires for a tubular wire stranding machine adapted to manufacture cables from wires unwound from the reels, these wires being for example of steel.

2. Description of the Prior Art

The wire stranding machine may comprise a variable number of reels, for example twenty-six, disposed in cradles acting as a support, and these reels are unwound at the same time, so as to form at the output side of the machine a single cable. The latter is provided for industrial uses, for example in public works or the oil or mining industry, etc . . .

Such a machine must of necessity undergo frequent stoppages to permit the changing of one or more completely unwound reels. The stoppages are a function of the length of wire contained in each of the reels, which length differs in accordance with the diameter of the wire employed. Indeed, wires of different diameters are laid around a core wire. The diameter of the wire of several reels may be different so that the length of the wire is also different.

It will therefore be understood that this presents a problem for the operator supervising the operation of the wire stranding machine to foresee and carry out all these reel changes.

Further, all the operations for unloading the empty reel, loading the full reel and discharging the empty reel, etc . . . , and the monitoring operations have been carried out manually up to the present time.

The replacement of a empty reel is effected manually in the following manner:

The operator notices that a reel among those being unwound is almost completely unwound and he decides to stop the machine. The tubular stranding machine stops, the hood of the considered reel is opened so as to have access to the reel support cradle. The operator cuts the wire remaining on the reel to be changed and connects it to the substituted full reel. He manually opens the locking points or studs maintaining the reel on its support cradle. He extracts the empty reel by means of a pulley-block and conveys it to the discharging zone. He takes by means of the pulley-block a suitably chosen full reel whose characteristics are identical to those of the reel being changed, in a preparation bay. These bays are equal in number to the number of diameters of different wires in the cable being manufactured, for exemple six, which corresponds therefore to six different wires for twenty-six reels.

The operator transports the full reel to a support cradle and lowers it onto the latter. He closes the points whereby the reel is held in position on the cradle. He must then connect the wire of the new reel to the remaining wire of the previous reel, for example by welding the two ends of these wires. He closes the hood of the stranding machine and starts up the latter. On this type of machine, several reels of the same type must sometimes be replaced at the same time. The operations described hereinbefore must therefore be repeated for each reel to be replaced.

It will be understood that all these operations are both time continuing and costly, since they markedly reduce the productivity of the stranding machine, and are dangerous for the operators in charge of these operations and for the stranding machine.

SUMMARY OF THE INVENTION

An object of the invention is therefore to provide a robot capable of automatically carrying out all the aforementioned operations which were heretofore carried out manually, by means of a mechanical structure and a microcomputer associated with suitable control programs.

According to the invention, the robot comprises:

(a) A mechanical unit comprising a motorized device provided with reel seizing tongs capable of moving from one end to the other of the stranding machine under the action of driving means for extracting the empty reels and replacing them with full reels prepared beforehand in supply passageways each corresponding to a wire diameter, and (b) an automatic control and programmed monitoring microcomputer system for the operations carried out by the mechanical unit.

According to an embodiment of the invention, the mechanical unit of the robot comprises the following elements:

- a rail disposed above the stranding machine and extending throughout the length of the latter;
- a motorized carriage bearing against the rail and capable of being driven from one end to the other of the latter by a motor;
- a turret carried by the carriage, provided with means for driving it in rotation through 180° about a vertical axis and provided with two movable tongs capable of rising or descending under the action of raising and lowering means provided in the turret;
- the tongs being equipped with jaws capable of opening and closing onto the reels for seizing and disposing them in positions indicated by the programs of the microcomputer.

With the stranding machine in operation, the full reels are transported from the supply passageways to standby stations provided in facing relation to each cradle of the stranding machine outside the latter. Then, after stoppage of the stranding machine, these full reels are placed in the corresponding cradles so as to be substituted, as required, for the empty reels.

According to other features of the invention, the microcomputer is programmed and the mechanical unit is provided with means enabling the robot to carry out, as desired, a number of sequences, for example the following two sequences:

(a) with the stranding machine still in operation, the seizing of a reel by means of tongs in a supply passageway in accordance with the diameter of the selected wire, and the transfer of this reel to the corresponding station along the stranding machine for awaiting the loading;

(b) after stoppage of the stranding machine, the replacement of an empty reel on the stranding machine by the full reel positioned in the corresponding standby station, by means of two pairs of tongs which are capable of, on one hand, pivoting around a vertical axis and, on the other hand, rising or descending: the motorized device located at a standby station at the end of the stranding machine arrives just above the indicated standby station, its two pairs of tongs are respectively placed above the empty reel and above the full reel, these tongs descend and seize the two reels, rise, pivot through 180°, once again descend, deposit the full reel in its cradle and the empty reel at the standby station, then the tongs rise and the motorized device returns to its initial standby station at the end of the stranding machine.

BRIEF DESCRIPTION OF THE DRAWINGS

Further features and advantages of the invention will be apparent from the following description with reference to the accompanying drawings, which illustrate by way of a non-limiting example, an embodiment of the robot according to the invention in which.

DETAILED DESCRIPTION OF THE PREFERRED EMBODIMENT

Figure 1:
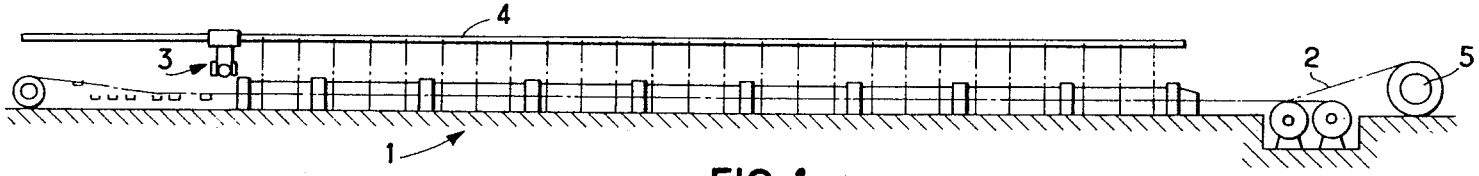
FIG. 1 is a diagrammatic elevational view of a tubular stranding machine for manufacturing twisted cables from wires unwound from reels by means of the robot according to the invention.
Figure 2:
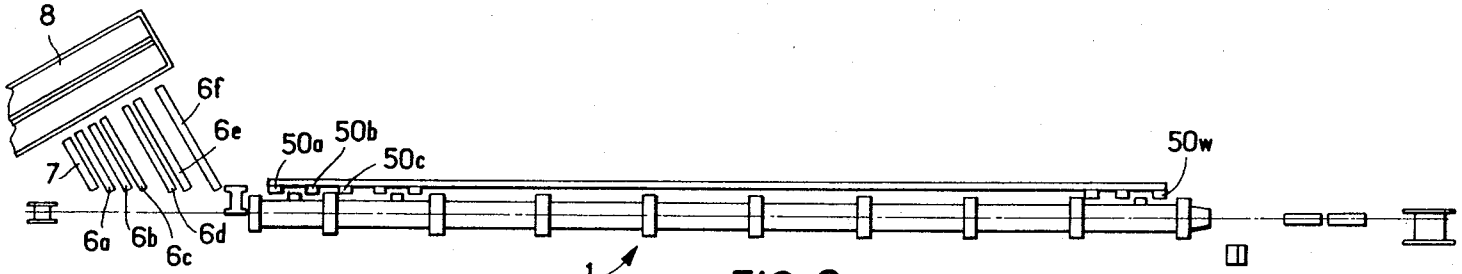
FIG. 2 is a plan view corresponding to FIG. 1.

The plant diagrammatically illustrated in FIGS. 1 and 2 comprises a tubular stranding machine 1 for manufacturing twisted cables 2 from wires unwound from a series of reels disposed one behind the other within the stranding machine 1, and a robot 3, 4 so constructed and programmed as to be capable of automatically carrying out sequences of operations for loading and unloading the reels with respect to the previously-stopped stranding machine 1. The robot comprises a mechanical unit including a motorized device 3 movable from one end to the other of the stranding machine 1 for extracting therefrom empty reels and replacing them with previously prepared full reels, a support rail 4 for the motorized device 3 located above the stranding machine 1 and extending throughout the length of the latter, and an automatic control and programmed monitoring microcomputer system for the operations carried out by the mechanical unit 3, 4.

The stranding machine 1 is known per se and will therefore not be described in detail. It consists of a given number of cradles each capable of receiving a reel to be unwound, disposed in hoods located one behind the other so as to form a tubular structure. The stranding machine 1 comprises, in the embodiment shown in FIGS. 1 and 2, twenty-six cradles and as many reels whose wires are twisted in succession together so as to form the cable 2 wound on a reel 5.

The full reels are disposed in supply passageways each corresponding to a given diameter of wire, namely six passageways 6*a*–6*f* in the presently-described embodiment, a passageway or bay 7 for discharging the empty reels being also provided. The plant is completed by a platform 8 for storing full and empty reels and by twenty six standby stations 50*a*. . . 50*z*, located in facing relation to the associated cradles and capable of receiving full reels awaiting loading and empty reels awaiting discharge.

The motorized device 3 constituting the active part of the robot will now be described with reference, more particularly, to FIGS. 3 to 6.

The device 3 comprises the following elements:

- a motorized carriage 9 bearing against the rail 4 and capable of being driven from one end to the other of the latter by a motor-speed reducer unit 11;
- a turret 13 carried by the carriage 9, provided with a motor 12 for driving it in rotation through 180° about a vertical axis, and provided with two movable tongs 14 capable of being raised and lowered under the action of raising and lowering means provided in the turret 13. These means are arranged in a conventional manner, for example comprise chains or belts 23 associated with wheels 22 (FIG. 4), the tongs 14, each including two jaws 15 being adapted to be opened and closed onto the reels, such as 40 (FIG. 3) for seizing and placing them in the positions indicated by the programs of the microcomputer.

The rail 4 carrying the motorized device 3 is integral with a fixed frame 17 extending along the stranding machine 1 and it has on its upper side a runway receiving rollers 18 of the carriage 9 whose motor-speed reducer unit 11 drives a gear pinion 19 engaged with a rack 21 fixed to the rail 4 so that when the motor-speed reducer 11 is started up, the whole of the device 3 can be driven in either direction along the stranding machine 1.

Figures 4, 4A:
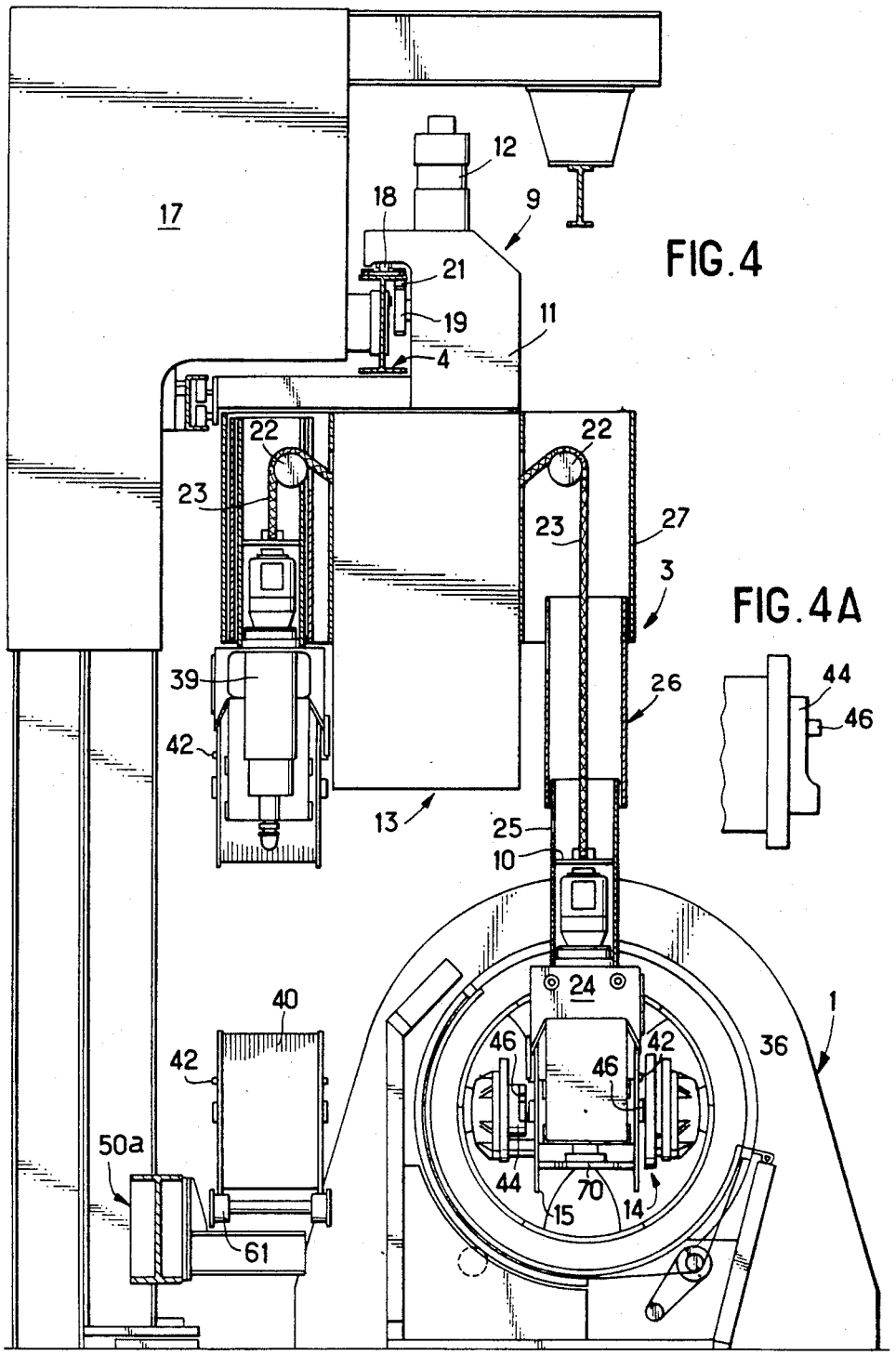
FIG. 4 is a side elevational view of the robot and a cross-sectional view of the stranding machine in a plane perpendicular to that of FIG. 3.
FIG. 4A is a detail view to an enlarged scale of the stranding machine.

The means for raising and lowering the tongs 14 comprise two motor-speed reducer units disposed within the turret 13 (not seen in FIG. 4) and capable of raising or lowering the tongs 14 through respective pulleys 22 each receiving a belt 23 at the end of which a corresponding pair of the tongs 14 is suspended. Each pair of tongs 14 is furthermore suspended from the turret 13 by means of a telescopic support means constructed in the following manner: the jaws 15 are articulated in a housing 24 fixed to a first vertical tube 25 which is connected to the corresponding belt 23 through a transverse element 10 (FIG. 4). A second tube 26, in which the tube 25 is capable of fitting and an upper fixed tubular portion 27 connected to the turret 13. The two movable tubes 25, 26 are capable of being disposed in this upper portion 27 when the tongs 14 are in the upper position as shown on the left side of FIG. 4. When the tongs 14 are in the lower position as illustrated on the right side of FIG. 4, the tubes 25, 26 are extended and the jaws 15 of the tongs 14 are located at the level of the reels of the stranding machine 1.

Figure 3:
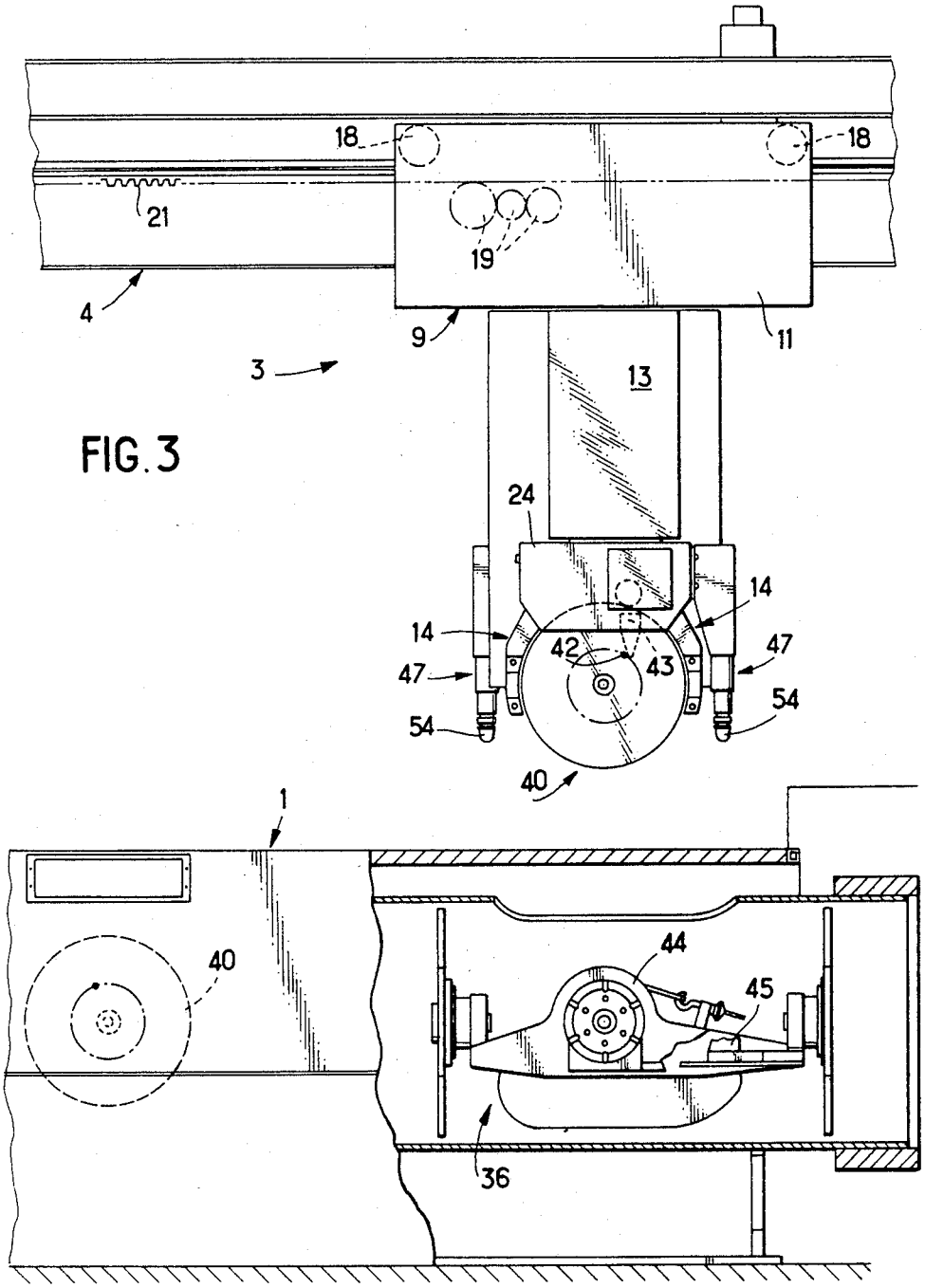
FIG. 3 is a longitudinal elevational view of the robot and a partial elevational view of the stranding machine showing a reel cradle above which the robot is located.
Figure 5:
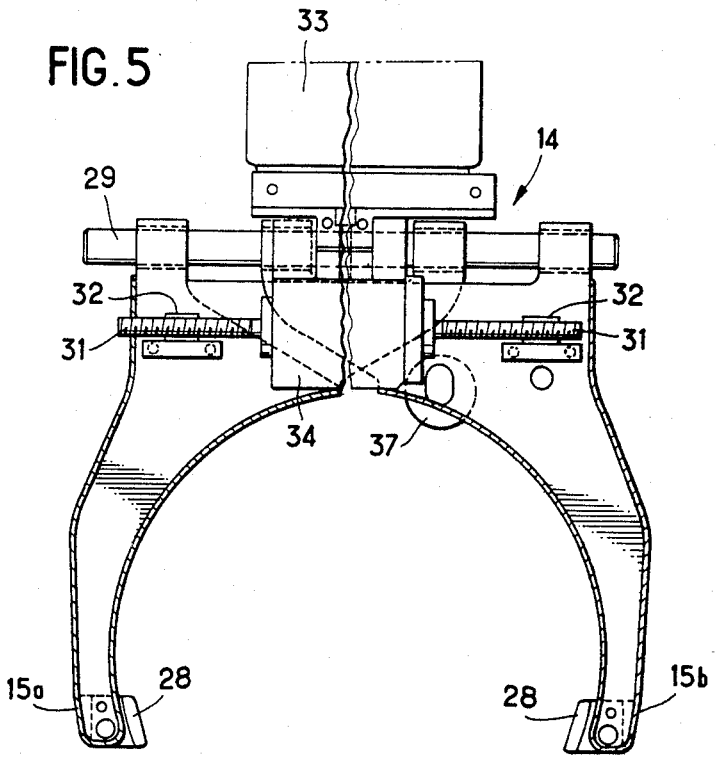
FIG. 5 is a vertical sectional view with parts cut away of a pair of tongs of the robot.
Figure 6:
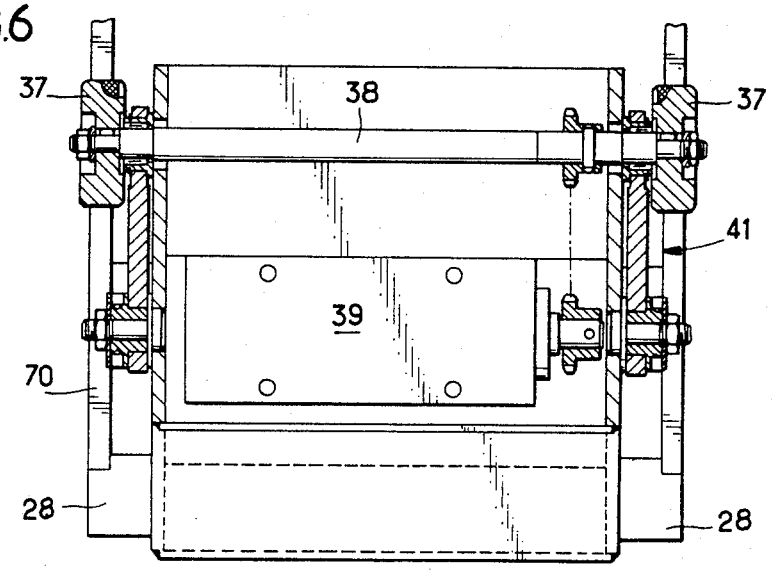
FIG. 6 is a semi-sectional and semi-elevational view of a device for driving in rotation a reel seized by a pair of tongs of the robot.

The device controlling the jaws 15 of tongs 14 is shown in detail in FIG. 5: each jaw 15*a*, 15*b* is provided with an end jaw block 28 for gripping the reel (not shown) and has, in its upper part, a guide shaft 29 which extends therethrough and a driving screw 31 which extends through a tapped sleeve 32 mounted on the respective jaw 15*a*, 15*b*. Each screw 31 may be rotated in one direction or the other by a motor 33 which cooperates with a speed-reducer 34, so that the jaws 15*a*, 15*b* can be moved in translation in either direction on the guide shaft 29 so as to seize a reel 4 or release the reel. The jaw 15*a* in on the left side of FIG. 5 is shown in the closed position and the jaw 15*b* on the right side of FIG. 5 is shown in the open position of the tongs 14. jaw 15*b* is in the open position of The turret 13 is provided with means for driving in rotation an empty reel such as 70 (FIG. 6) in its cradle 36 (FIG. 4) and for detecting an angular position of this reel in which the latter can be removed. In the presently-described embodiment, the means for driving the reel in rotation comprise two rollers 37 (FIG. 6) mounted on the ends of a shaft 38 and capable of being driven in rotation by a motor 39 through means 41 known per se which will consequently not be described in detail. The rollers 37 are so positioned as to be capable of bearing against the cheeks of a reel, such as 70, and may be driven in rotation, so as to turn the reel in the desired direction. The means for detecting the angular position of the reel comprise a pin or dog 42 which laterally projects from the reel (FIGS. 3 and 4) and a detector 43 mounted in the lower part of the turret 13, so that the pin 42 can come into contact with this detector 43 when the reel has turned about its axis through a sufficient angle, as shown in FIG. 3. The detector 43 is part of an electric monitoring circuit which informs the microcomputer that the corresponding angular position of the reel allowing its extraction from the cradle 36 is reached. Indeed, during the rotation of the reel in its cradle 36 in the course of the unwinding of the wire, its pin 42 is made to effect successive passages below a part 44 of the cradle 36 (FIGS. 3, 4 and 4*a*) so that the extraction out of the cradle 36 of an empty reel requires the prior positioning of the reel in an angular position in which its pin or dog 42 is brought above the part 44, this rotation of the empty reel in its cradle 36 being produced by the device described hereinbefore with reference to FIGS. 3 and 6.

Figure 7:
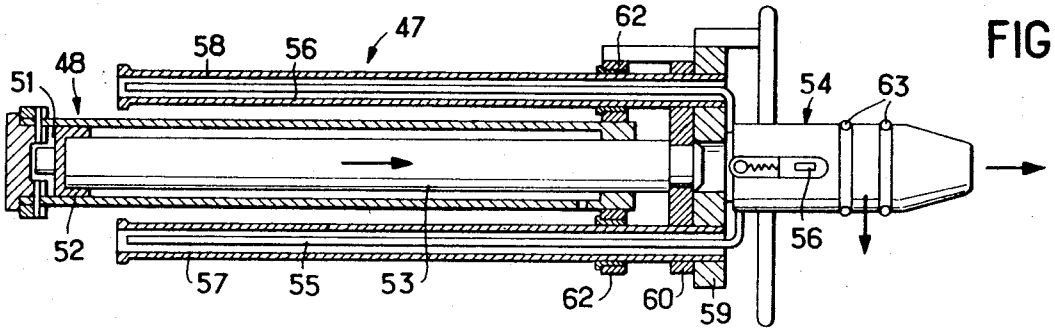
FIG. 7 is a semi-sectional, semi-longitudinal elevational view to an enlarged scale with repect to FIGS. 3 and 4, of an unlocking device for unlocking the empty reels from their cradle, this device being an integral part of the robot.

Further, according to a feature of the invention, each of the tongs 14 is provided with means for controlling the unlocking of the empty reels in their respective cradles 36. In the embodiment illustrated in FIGS. 3, 4 and 7, these means comprise devices 47 for injecting compressed gas (compressed air) into indexing elements 45 of the cradles 36 capable of causing, as a result of these injections of compressed gas, the retraction of studs or counterpoints 46 (FIGS. 4 and 4A) which may be shifted in a direction parallel to the axis of the reel (and therefore in a direction perpendicular to the general axis of the stranding machine 1) so as to be engaged in the reel for locking it in position in its cradle 36. The manner in which the indexing elements 45 cause the lateral retraction of the locking studs 46 following on the injection of compressed air is known per se and will consequently not be described.

Associated with each pair of indexing elements 45 is a pair of the devices 47 for injecting gas fixed by means known per se to the lower tubes 25 of the corresponding tongs 14 in such manner as to be capable of accompanying the rising and descending movements of the tongs. Each injection device 47 (FIG. 7) comprises a pneumatic jack 48 having at its end a gas inlet (compressed air inlet) communicating with a chamber 51 for shifting a piston 52 mounted on a rod 53 at the end of which there is fixed a head 54 for injecting gas into the associated indexing element 45 through an orifice (not seen in FIG. 7). The compressed gas may be injected into the head 54 through a pipe 55 which is parallel to the rod 53 and is disposed in a guide tube 57 connected to the head 54 by interposed fixing members 59, 60 which are fixed to the rod 53. The guide tube 57 extends through a support 62 fixed to one end of the cylinder of the jack 48 and in which it is slidable to accompany the to-and-fro movements of the head 54 and the rod 53. The sources of the supply of compressed air to the jack 48 and the head 54 have not be shown.

The head 54 is provided with a pair of sealing O-rings 63 between which there is formed the outlet of the control gas into the associated indexing element 45 which provides the sealing of this injection. The injection device 47 is provided with an electric contact 56 which extends from the head 54 in a lateral tube and which has for its function to ensure the detection of the locked position of the reel when it is desired to initiate its unlocking by the injection of compressed gas into the jack 48 and the conduit 55.

It will therefore be understood that when it is desired to unlock an empty reel from its suppoprt cradle 36, the tongs 14 are lowered with the jaws 15 spread apart so as to surround the reel by inserting each of the two heads 54 in the associated indexing element 45 by the actuation of the jacks 48. Thereafter, compressed air is injected through the tubes 55 and passes through the heads 54 and causes the retraction of the studs 46 so as to unlock the reel and allow its extraction after the clamping of the jaws 15 on its cheeks, by the raising of the tongs 14 and the shifting of the telescopic system 25, 26, 27 from its extended position shown on the right side of FIG. 4 to its upper retracted position shown on the left side of this Figure.

Each of the standby stations (50*a* . . . ) is arranged in the known manner for receiving a full reel 40 before it is loaded into the associated cradle 36, the reel 40 resting on a set of rollers 61.

Assuming that a full reel 40 is placed in its standby position at a station, such as 50*a* and that the corresponding reel in the stranding machine is completely unwound, the changing of this empty reel is effected in the following manner: the operator causes the complete stoppage of the stranding machine 1, opens the hood corresponding to the cradle 36 of the empty reel (this operation may also be carried out by the robot), cuts the wire remaining on the reel and instructs the robot whose motorized device 3 has been previously put in the standby position at the rear end of the stranding machine 1 close to the supply passageway 6*a*–6*e*, to place itself above the empty reel and the full reel 40 which must replace it. The program of the microcomputer controls this displacement and the following operations: the motor 12 causes the turret 13 and the tongs 14 to pivot in such manner as to place each one of the latter respectively above the full reel 40 and the empty reel. Then, the raising and lowering motor-speed reducer units cause the descent of the tongs 14 and the devices 47, the jaws 15 being in the spread-apart position (position of the jaw 15*b* shown in FIG. 5). The devices 47 associated with tongs 14 which must extract the empty reel from the stranding machine 1 inject compressed gas into the indexing elements 45 which then cause the retraction of the studs 46 and the unlocking of the reel from its cradle 36. The motor 39 rotates the two rollers 37 and the latter rotate the empty reel until its projecting pin 42 reaches the upper position in contact with the detector 43 which then delivers an electric instruction signal to stop the motor 39. The motor 33 associated with the tongs 14 which must extract the empty reel causes the clamping of the jaws 15 of the tongs onto the reel, then the raising and lowering motor-speed reducer unit corresponding to these tongs 14 causes the raising of the empty reel in the course of which the tubes 25, 26 slide one inside the other and then into the upper tube 27. During these operations, the second tongs 14 disposed above the full reel 40 are lowered so as to seize the latter by a procedure similar to that just described, except of course for the operation of the corresponding unlocking devices 47 and the rollers 37. When the two reels are placed in the upper position by the two tongs 14, the motor 12 causes the rotation of the assembly through 180° about a vertical axis so as to place the full reel 40 above the cradle 46 and the empty reel above the standby station (for example 50*a*). The tongs 14 which support the full reel descend, their devices 47 inject compressed air into the indexing elements 45 so as to retract the studs 46 and allow the full reel to be placed in position. After the stoppage of the injection of compressed gas, the studs 46 automatically resume their position and lock the reel in its cradle 36. Then the jaws 15 are spread apart so as to allow the raising of the tongs 14. The robot can then move, for example to the discharge passageway 7, so as to deposit the empty reel therein, and is ready to effect another sequence of operations in accordance with the instructions of the operator and the program. As the motorized device 3 moves away, the operator manually welds the free end of the wire of the full reel to the remaining end of the wire and starts up the stranding machine.

The program of the microcomputer controlling the robot just described may be arranged to permit the robot to carry out one of the following sequences:

(a) With the stranding machine in operation, and therefore in masked time, the seizing of a reel 40 by means of the tongs 14 in a supply passageway in accordance with the diameter of the selected wire and the transfer of this reel 40 to the corresponding station 50*a* along the stranding machine 1 in the loading standby position;

(b) With the stranding machine inoperative, subtution of an empty reel 70 in the stranding machine by the full reel 40 located at the corresponding standby station at the end of pairs of tongs 14 which are pivotable about a vertical axis and are capable of rising or descending: the motorized device located at a standby station at the end of the stranding machine 1 arrives just above the indicated standby station 50*a* . . . 50*z*, its two pairs of tongs 14 are placed respectively above the empty reel 70 and above the full reel 40, these tongs descend and seize the two reels, rise, pivot through 180°, once again descend, deposit the full reel 40 in its cradle 36, and the empty reel 70 at the standby station, then the tongs 14 rise and the motorized device 3 returns to its initial standby-station at the end of the stranding machine;

(c) With the stranding machine still inoperative, the replacement of a series of empty reels 70 by full reels 40: the motorized device 3, in leaving its standby station close to the rear end of the stranding machine, first of all changes the empty reel which is the closest to this end in accordance with the aforementioned sequence b); then it travels toward the following empty reel to be changed while the operator welds the free end of the remaining wire, the robot thus automatically effecting the programmed replacements after the last of which the motorized device 3 returns to its standby station close to the rear end of the stranding machine ready to to receive the following instruction, for example: discharge of the empty reels 70 through the neighbouring passageway 7 of the passageways (6*a* . . . 6*e*) and replacement of these reels by full reels;

(d) (Stranding machine inoperative): emptying of all the reels of the stranding machine: the motorized device 3 is shifted from its end standby station to the cradle 36 which is located the closest to the rear end of the stranding machine, extracts the reel therefrom and repeats this operation on the following cradle and then returns the two empty reels to the passageway 7 for discharging the empty reels, and repeats this operation the required number of times for emptying the stranding machine;

(e) (Stranding machine inoperative): discharge of all the empty reels from the standby stations 50*a* . . . 50*z* along the stranding machine 1: the motorized device 3 leaves its standby station close to the nose of the stranding machine and takes up the closest empty reel by means of its first tongs 14, and then the following reel with its second tongs, returns these two empty reels to the discharging passageway 7 and repeats this operation the required number of times for emptying the standby stations.

Figure 8:
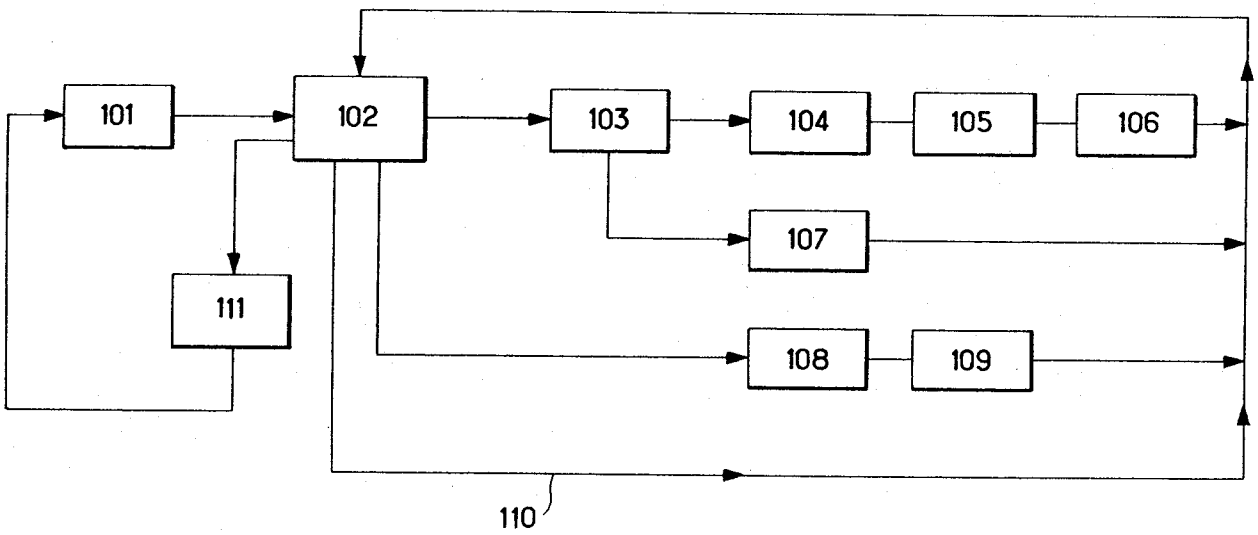
FIG. 8 is a flow chart representing the general layout of the loading and unloading operations for a reel.

There will now be described with reference to FIG. 8 the general procedure for preparing the loading of all of the standby stations 50*a* . . . 50*z* with full reels.

101: standby;

102: the passage from 101 to 102 corresponds to a manual preparation of the operator who instructs the robot to search the first preparation to be effected;

103: the robot detects that the passageway indicated to it by the program (6*a* or 6*b*) is supplied with reels loaded with wire of the required diameter. It then takes up this reel by means of one of its tongs 14;

104: the robot is conveyed to the indicated standby station (50*a*, or one of the following stations) and detects that an empty reel is located at this station: it then removes this reel from its support by means of the tongs which remain available;

105: the robot deposits the full reel at the standby station which has just been left by its empty reel;

106: the robot returns along the rail 4 to the discharging passageway 7 in which it deposits the empty reel and then automatically returns to the situation 102;

107: in the situation 103, the robot detects that there is no reel in the indicated standby station; it then deposits the full reel and then automatically returns to the situation 102;

108: starting from the position 102, the robot detects that there is no reel in the indicated supply passageway, but that there is an empty reel at the indicated standby station. It then remove this empty reel and then deposits it (situation 109) in the discharging passageway 7 and automatically returns to its position 102;

110: starting at situation 102, the robot detects that the considered supply passageway is empty and that there is moreover no reel at the indicated standby station; it is looped onto itself and remains in its position 102;

111: the operator delivers the instruction which puts the robot at rest so that the latter assumes the standby situation 111 and awaits an instruction from the operator.

Figure 9:
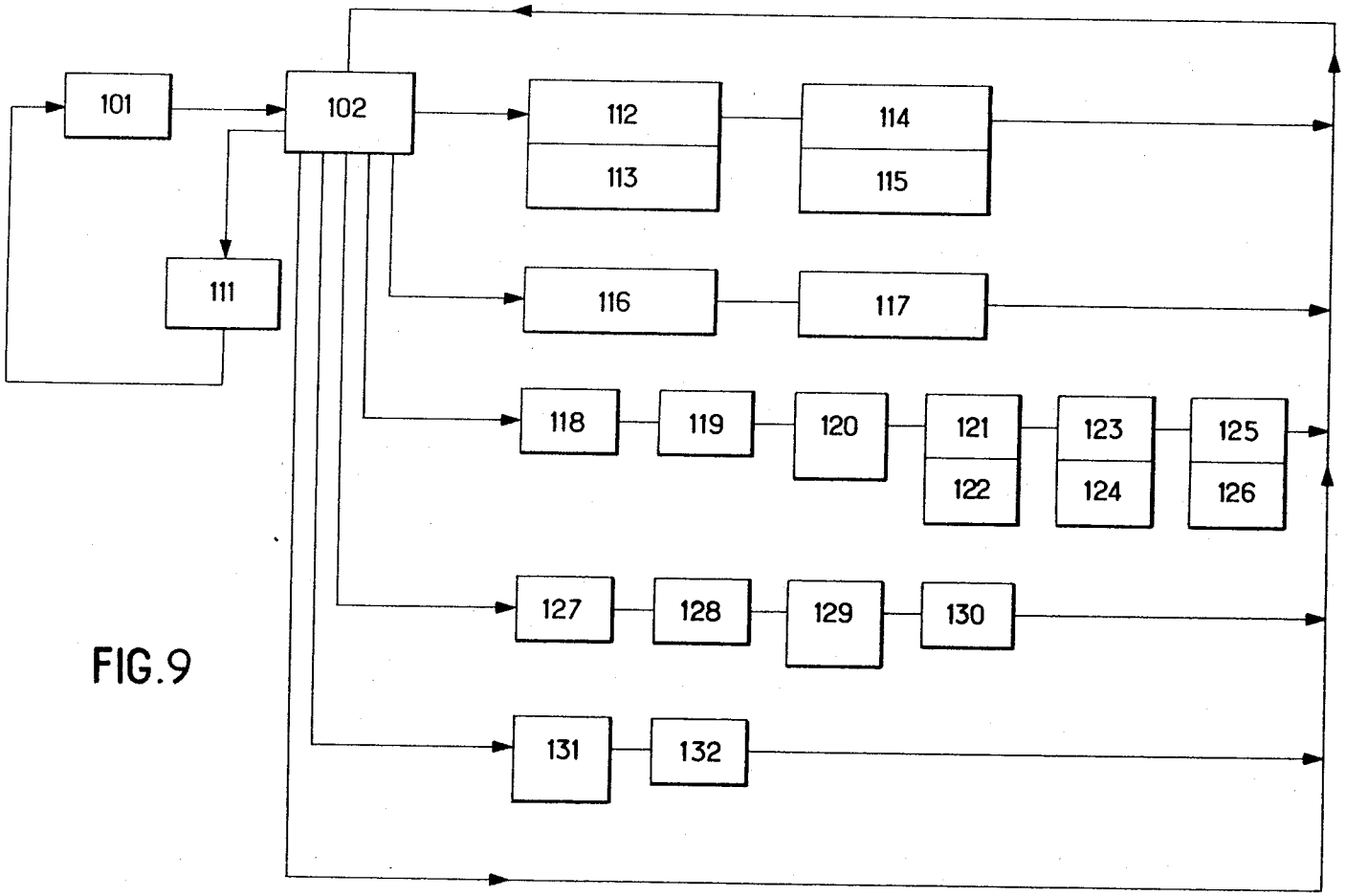
FIG. 9 is a detailed flow chart illustrating various sequences of operations which may controlled automatically by the program of the microcomputer of the robot.

There will now be described with reference to the flow chart of FIG. 9 several sequences of operation of the robot for carrying out the changing of a reel in its cradle.

First sequence

112: starting as in the preceding situation 102, the robot detects that a full reel is ready at the standby station indicated thereto, that the supply passageway corresponding to this wire diameter is itself supplied with reels, and that there is an empty reel to be changed in the cradle. It is placed in the suitable position above the full reel and seizes it with its first tongs while taking up the empty reel in the cradle with its second tongs (113);

114: the robot deposits the full reel in the cradle and the empty reel in the support of the standby station 115, and then returns to its preceding situation 102.

Second sequence

116: the robot has detected that the indicated standby station was provided with a full reel, that the corresponding passageway was supplied, but that there is no empty reel in the cradle. It takes up the full reel on its support with one of its tongs,. and then deposits it in its cradle (117) and automatically returns to its situation 102.

Third sequence

118: the robot detects that there is an empty reel in the cradle, that the corresponding passageway is supplied with reels, and that an empty reel is at the standby station corresponding to this cradle. It then removes the empty reel from its standby station;

119: it deposits this reel in the discharging passageway 7;

120: it takes a full reel from the desired supply passageway (6*a* or 6*b* . . . );

121, 122: the robot is placed above the empty cradle and the standby station associated with the full reel above the latter;

123, 124: the robot takes the empty reel from the cradle, then pivots through 180°;

125, 126: the robot deposits the full reel in the cradle and the empty reel at the standby station and then automatically returns to its situation 102.

Fourth sequence

127: the robot has detected that there are empty reels at the indicated standby station and in the corresponding cradle and that, moreover, the associated supply passageway has no full reel; it then removes the empty reel from the standby station;

128: the robot deposits this reel in the discharging passageway 7;

129: takes up the empty reel from its cradle;

130: and deposits it at the associated standby station, and then returns to its initial situation 102.

Fifth sequence

131: the robot detects that the indicated standby station and the corresponding supply passageway are empty, but that there is an empty reel in the cradle; it takes this reel;

132: and deposits it at the associated standby station, and then returns to the situation 102.

Sixth sequence starting at situation 102, the robot detects that there is no reel in the indicated cradle, and that the corresponding supply passageway is empty; it is then looped onto itself and carries out no operation.

We claim:

1. A robot for loading reels containing metal wires in and unloading empty reels from a tubular stranding machine for manufacturing cables from wires unwound from the wire containing reels, comprising:

(a) a mechanical unit comprising a motorized device provided with tong means for seizing and releasing the wire containing and empty reels, the mechanical unit including driving means for moving the motorized device back and forth between opposite ends of the stranding machine to remove the empty reels and replace them with full reels previously prepared and stored at supply passageways located along the stranding machine, each of the passageways storing full reels containing wire of a desired wire diameter, the mechanical unit including means for raising and lowering the tong means and means for rotating the tong means through 180°;

(b) and control means for automatic control and programmed monitoring of operations carried out by the mechanical unit so that said mechanical unit transports reels containing wires from the supply passageways to respective standby stations, each of the standby stations being in facing relation to a respective cradle for holding a reel of the stranding machine, said control means further controlling said mechanical unit to replace empty reels in cradles of the stranding machine with full reels so as to replace progressively the corresponding empty reels, wherein the control means is programmed and the mechanical unit carries out an operation selected from the group consisting of:

(i) seizing a wire containing reel by in one of said supply passageways with said tong means, as a function of the diameter of the selected wire and transferring the seized reel to a corresponding one of the standby stations along the stranding machining;

(ii) replacing an empty reel in a cradle of the stranding machine while the machine is stopped with a full reel positioned at one of the corresponding standby stations by moving the motorized device from a standby station at the end of the stranding machine to a position above the indicated standby station, removing the empty reel from the respective cradle of the stranding machine and the full reel from the respective standby station with the tong means, rotating the tong means through 180°, depositing the full reel in the respective cradle and depositing the empty reel at the respective standby station, and returning the motorized device to the standby station;

(iii) replacing a series of empty reels with full reels by moving the motorized device from a standby station close to the rear end of the stranding machine to a position over one of the cradles of the stranding machine containing an empty reel which is the closest to the rear end of the stranding machine and interchanging a full reel at a respective standby station with the empty reel while the machine is stopped, moving the motorized device to the rear end of the stranding machine and thereafter moving the motorized device to a position over one of the cradles containing another empty reel to be changed which is the next empty reel in the series of empty reels to be replaced thus allowing an operator to weld the wire of the replaced full reel to the free end of the remaining wire in the stranding machine, whereby the robot thus automatically effects the programmed replacement of full reels for all of the empty reels after which the motorized device is moved to the standby station close to the rear end of the stranding machine, ready to receive further instructions from the control means;

(iv) removing all of the reels in the cradles of the stranding machine while the machine is stopped by moving the motorized device from a standby station to a position over a respective one of the cradles located closest to the rear end of the stranding machine, removing an empty reel therefrom and moving the motorized device to a position over the next succeeding standby station and removing an empty reel therefrom, then moving the motorized device to a discharging passageway and releasing the empty reels thereat and repeating the removal of empty reels until all empty reels have been removed from the stranding machine; and (v) removing all of the empty reels from the standby stations along the stranding machine by moving the motorized device from a standby station close to the rear end of the stranding machine to a position over the closest empty reel and seizing the empty reel with the tong means, then moving the motorized device to a position over the next empty reel and seizing it with the tong means, moving the motorized device to a discharging passageway and repeating the removal of empty reels until all empty reels have been removed from the standby stations.

2. A robot according to claim 1, wherein said means for moving includes a rail supported above the stranding machine and extending throughout the length thereof and a motor for driving said motorized device along the rail;

said motorized device comprising a motorized carriage supported for movement on the rail and capable of being driven by said motor from one end to the other of the rail;

said mechanical unit further comprising a turret carried by the carriage, said turret including said means for rotating said tong means to rotate said tong means about a vertical axis, said tong means comprising two pairs of movable tongs and said means for raising and lowering said tong means being supported on the turret, said tongs including jaws and means for opening and closing said jaws onto the reels for seizing them and depositing the reels as directed by said control means.

3. A robot according to claim 2, wherein each of said pairs of tongs includes means for unlocking empty reels from their respective cradles in which the reels are supported, said unlocking means comprising means for injecting compressed gas into indexing elements of the cradles to effect retraction of studs locking the reels in their cradles so as to permit the removal of an empty reel or the loading of a full reel in the associated cradle.

4. A robot according to claim 3, wherein the turret includes means for rotating an empty reel in one of said cradles before removal of the empty reel therefrom by the tongs, the turret and a respective reel further including means for detecting an angular position of the respective reel supported in one of the cradles whereby the reel can be rotated by said reel rotating means to a desired angular position for removal of the reel from the cradle in which it is supported by one of said pairs of tongs.

5. A robot according to claim 4, wherein said reel rotating means comprise rollers supported for rotation by said turret, motor means supported by the turret for rotation of the rollers, the rollers being engageable with a reel in its cradle for rotating the reel, said detecting means comprising a pin projecting from said reel and a detector supported on the turret which engages said pin when the angular position of the reel in its cradle permits removal of the reel therefrom by one of said pairs of tongs.

6. A robot according to claim 3, wherein the means for unlocking empty reels by retracting the locking studs of the cradles from the reels comprise at least one pneumatic jack having a rod at an end thereof and a head fixed to an end of the rod, the head including a conduit therein for injection of compressed gas into the corresponding indexing element of the cradle.

7. A robot according to claim 2, wherein said means for raising and lowering said tongs includes telescopic support means extending between each of the pairs of tongs and the turret and a motor-speed reducer unit means for extending and retracting the telescopic support means to thereby lower and raise the tongs.

8. A robot for loading reels containing metal wires in and unloading empty reels from a temporarily stopped tubular stranding machine for manufacturing cables from wires unwound from the wire containing reels, the stranding machine including a plurality of cradles for supporting reels containing wire of various diameters, supply passageways being located along the stranding machine, each of the supply passageways storing reels containing wire of a predetermined diameter and standby stations being located along the stranding machine such that each standby station is adjacent one of the cradles, the robot comprising:

(a) a mechanical unit comprising a motorized device provided with tong means for seizing and releasing the wire containing and empty reels, the mechanical unit including driving means for moving the motorized device back and forth between opposite ends of the stranding machine to remove the empty reels from the cradles, the standby stations and the supply passageways and replace the empty reels with full reels previously prepared and stored at the supply passageways, the mechanical unit including means for raising and lowering the tong means and means for rotating the tong means through 180°; and (b) control means for automatic control and programmed monitoring of operations carried out by the mechanical unit so that said mechanical unit transports reels containing wires from the supply passageways to the respective standby stations and said control means further controlling said mechanical unit to replace empty reels in the cradles of the stranding machine with full reels.

9. A robot according to claim 8, wherein said means for moving includes a rail supported above the stranding machine and extending throughout the length thereof and a motor for driving said motorized device along the rail;

said motorized device comprising a motorized carriage supported for movement on the rail and capable of being driven by said motor from one end to the other of the rail;

said mechanical unit further comprising a turret carried by the carriage, said turret including said means for rotating said tong means to rotate said tong means about a vertical axis, said tong means comprising two pairs of movable tongs and said means for raising and lowering said tong means being supported on said turret, said tongs including jaws and means for opening and closing said jaws onto reels for seizing them and depositing the reels as directed by said control means.

10. A robot according to claim 9, wherein each of said pairs of tongs includes means for unlocking empty reels from their respective cradles in which the reels are supported, said unlocking means comprising means for injecting compressed gas into indexing elements of the cradles to effect retraction of studs locking the reels in their cradles so as to permit the removal of an empty reel or the loading of a full reel in the associated cradle by one of the pairs of tongs.

11. A robot according to claim 10, wherein the turret includes means for rotating an empty reel in one of said cradles before removal of the empty reel therefrom by the tongs, the turret and a respective reel further including means for detecting an angular position of the respective reel supported in one of said cradles whereby the reel can be rotated to a desired angular position for removal of the reel from the cradle in which it is supported by one of the pairs of tongs.

12. A robot according to claim 11, wherein said reel rotating means comprise rollers supported for rotation by said turret, motor means supported by the turret for rotation of the rollers, the rollers being engageable with a reel in its cradle for rotating the reel, said detecting means comprising a pin projecting from said reel and a detector supported on the turret which engages said pin when the angular position of the reel in its cradle permits removal of the reel therefrom by one of the pairs of tongs.

13. A robot according to claim 19, wherein the means for unlocking empty reels by retracting the locking studs of the cradles from the reels comprise at least one pneumatic jack having a rod at an end thereof and a head fixed to an end of the rod, the head including a conduit therein for injection of compressed gas into the corresponding indexing element of the cradle.

14. A robot according to claim 9, wherein said means for raising and lowering said tongs includes telescopic support means extending between each of the pairs of tongs and the turret and a motor-speed reducer unit means for extending and retracting the telescopic support means to thereby lower and raise the tongs.

15. A method for loading reels containing metal wires in and unloading empty reels from a tubular stranding machine for manufacturing cables from wires unwound from the wire containing reels by means of a robot comprising:

(a) a mechanical unit comprising a motorized device provided with tong means for seizing the wire containing and empty reels, the mechanical unit including driving means for moving the motorized device back and forth between opposite ends of the stranding machine to remove the empty reels and replace them with full reels previously prepared and stored at supply passageways located along the stranding machine, each of the passageways storing full reels containing wire of a desired wire diameter, the mechanical unit including means for raising and lowering the tong means and means for rotating the tong means through 180°; and (b) control means for automatic control and programmed monitoring of operations carried out by the mechanical unit so that said mechanical unit transports reels containing wires from the supply passageways to respective standby stations, each of the standby stations being in facing relation to a respective cradle for holding a reel of the stranding machine, said control means further controlling said mechanical unit to replace empty reels in cradles of the stranding machine with full reels so as to replace progressively the corresponding empty reels, wherein the control means is programmed and the mechanical unit carries out an operation in accordance with instructions from the control means, said method comprising a step selected from the group consisting of:

(i) seizing a wire containing reel in one of said supply passageways with said tong means, as a function of the diameter of the selected wire to be replaced in the stranding machine and transferring the seized reel to a corresponding one of the standby stations along the stranding machine;

(ii) replacing an empty reel in a cradle of the stranding machine while the stranding machine is stopped with a full reel positioned at one of the corresponding standby stations by moving the motorized device from a standby station at the end of the stranding machine to a position above the indicated standby station, removing the empty reel from the respective cradle of the stranding machine and the full reel from the respective standby station with the tong means, rotating the tong means through 180°, depositing the full reel in the respective cradle and depositing the empty reel at the respective standby station, and returning the motorized device to the standby station;

(iii) replacing a series of empty reels with full reels while the stranding machine is stopped by moving the motorized device from a standby station close to the rear end of the stranding machine to a position over one of the cradles of the stranding machine containing an empty reel which is the closest to the rear end of the stranding machine, seizing the empty reel in the cradle and the full reel at the standby station with the tong means, and interchanging the full reel at a respective standby station with the empty reel by rotating the tong means 180° and depositing the full reel in the cradle and the empty reel in the standby station, moving the motorized device to the rear end of the stranding machine and thereafter moving the motorized device to a position over one of the cradles contained another empty reel to be changed which is the next empty reel in the series of empty reels to be replaced thus allowing the operator to weld the wire of the replaced full reel to the free end of the remaining wire in the stranding machine, whereby the robot thus automatically effects the programmed replacement of full reels for all of the empty reels after which the motorized device is moved to the standby station close to the rear end of the stranding machine, ready to receive further instructions from the control means;

(iv) removing all of the reels in the cradles of the stranding machine while the stranding machine is stopped by moving the motorized device from a standby station to a position over a respective one of the cradles located closest to the rear end of the stranding machine, removing an empty reel therefrom with the tong means, rotating the tong means 180° and moving the motorized device to a position over the next succeeding standby station and removing an empty reel therefrom with the tong means, then moving the motorized device to a discharging passageway and releasing the empty reels from the tong means thereat and repeating the removal of empty reels until all empty reels have been removed from the stranding machine; and (v) removing all of the empty reels from the standby stations along the stranding machine by moving the motorized device from a standby station close to the rear end of the stranding machine to a position over the closest empty reel in one of the standby stations and seizing the empty reel with the tong means, then moving the motorized device to a position over the next empty reel and seizing it with the tong means, moving the motorized device to a discharging passageway and releasing the empty reels from the tong means thereat and repeating the removal of empty reels until all empty reels have been removed from the standby stations.

* * * * *